US005597160A

United States Patent [19]

Mims

[11] Patent Number: 5,597,160

[45] Date of Patent: Jan. 28, 1997

[54] BASEBALL BATTING TRAINING APPARATUS

[76] Inventor: Calvin Mims, 709 N. Cuyler Ave., Oak Park, Ill. 60302

[21] Appl. No.: 495,845

[22] Filed: Jun. 28, 1995

[51] Int. Cl.[6] ..... A63B 69/40

[52] U.S. Cl. ..... 124/16

[58] Field of Search ..... 273/26 R, 29 A, 273/34 A, 60 R; 124/16

[56] References Cited

U.S. PATENT DOCUMENTS

| | | | |
|---|---|---|---|
| 1,826,641 | 10/1931 | Waddell | 273/34 A |
| 3,138,381 | 6/1964 | Branneman | 273/26 R |
| 3,139,700 | 7/1964 | Wyrick | 273/26 R |
| 3,246,895 | 4/1966 | Traill | 124/16 |
| 3,446,199 | 5/1969 | Saveca | 124/16 |
| 3,545,752 | 12/1970 | Hill | 273/26 R |
| 3,612,027 | 10/1971 | Makino | 273/26 R |
| 3,627,319 | 12/1971 | Skyhawk | 273/26 R |
| 3,792,861 | 2/1974 | Coleman | 273/26 R |
| 3,856,300 | 12/1974 | Payne | 273/26 R |
| 4,129,110 | 12/1978 | Kubrak | 124/16 |
| 4,614,339 | 9/1986 | Schanwald | 273/60 R |
| 4,865,318 | 9/1989 | Lehmann | 273/26 R |
| 5,221,081 | 6/1993 | Rooks | 273/26 R |

*Primary Examiner*—Theatrice Brown
*Attorney, Agent, or Firm*—Robert G. Petrinec

[57] ABSTRACT

An apparatus for baseball batting training. The apparatus includes a rigid-wall cylindrical tube with means to support a baseball at one end thereof. A striker movable within the tube, is latched against a preselected force of a coil spring, and is rapidly urged toward the baseball for impingement therewith to propel the baseball upward a distance corresponding to the preselected force of the spring. When the striker is pushed down, a pin is visually extended and retracted to engage a selected one of a plurality of latching detentes to hold the striker in a cocked position. Upon release of the pin, the spring loaded striker is urged rapidly upward to impact with the baseball and propel the baseball into the hitting zone of a waiting batter. The inside diameter of the rigid-wall tube is larger than the small end of a baseball bat to allow the bat to be pushed into the tube and reset the apparatus for another use. Means are provided on the upper end of the striker to alter the point of contact with the baseball and thereby cause the baseball to move at selected upward angles. In this manner the baseball will be presented at different locations within the hitting zone to simulate either an inside pitch or an outside pitch during batting practice.

7 Claims, 3 Drawing Sheets

BASEBALL BATTING TRAINING APPARATUS

BACKGROUND OF THE INVENTION

1. Field of the Invention

This invention relates generally to batting training apparatus, used in the sport of baseball, for training individuals in the proper technique of swinging a baseball bat to hit a baseball.

The hand-eye coordination of a batter's swing is essential for successfully hitting a baseball. Professional and amateur baseball coaches spend a great deal of time teaching children and young adults the proper technique of swinging a baseball bat to hit a baseball with maximum force. The importance of this form of training has encouraged the development of several different forms of baseball throwing devices.

2. Brief Description of the Prior Art

Prior Art devices fall generally into two basic categories. The first is a device which throws a baseball at high speed within the hitting zone of a waiting batter. This type of device is most often used for training of young adults to sharpen their skills. The second form of devise is one which tosses a baseball gentle into the hitting area of the batter. It is this type of batting training device which the present invention relates to and provides an improvement.

Still another form of Prior Art training devices will gently propel a baseball, at slow speed, in a direction not toward the batter but usually vertically or from a side angle into the hitting zone in front of the batter. Generally, these devices propel a baseball at a reasonable slow speed whereupon, the batter can have sufficient time to swing the bat and hit the baseball. This action is repeated many times during the training process. It is not uncommon however, that with this method of training, it is the training device, and not the baseball, which is struck with the baseball bat. The repeated inadvertent striking of these Prior Art training devices will cause them to become inoperable thereby cutting short the training session. Because it is important that an individual repeat this practice many times, the training apparatus must continue to operate properly even after being inadvertently struck by the baseball bat. It is also important that new participants of the sport of baseball start their training with methods and devices which can be used all year long, either indoors or outdoors.

Prior art devices have been developed for this purpose and are disclosed in U.S. Pat. Nos. 3,545,752; 3,612,027; 3,627,319; 5,160,131; 5,221,081 and 5,294,109. These Prior Art devices provide means for projecting a baseball into the hitting zone of a batter. However, the Prior Art devices noted herein have complicated mechanical systems which are expensive to manufacture, difficult to maintain in proper working order and are complex in operation. Also, some Prior Art devices are large and cumbersome and cannot be stored or moved easily, while other Prior Art devices are fragile and do not withstand the vigorous use they are subjected to. These devices often become inoperative because of the abuse they receive by their users and require frequent repairs or replacement.

SUMMARY OF THE INVENTION

Therefore, it is an object of this invention to provide a new and improved baseball batting training apparatus for teaching proper hand-eye coordination for hitting a baseball and which apparatus is inexpensive to manufacture, easy to maintain and use.

Another object of this invention is to provide a baseball training apparatus which is compact in size and durable in construction.

A feature of this invention allows the baseball batting training apparatus to be latched, in a cocked state ready for use, by using the small handle end of a baseball bat.

Another feature of this present invention is to provide means for adjusting the force imparted to a baseball, thereby controlling the final height the baseball will achieve within the hitting zone, thereby compensating for the weight and size of the baseball.

Still another feature of this invention is to provide means in a baseball batting training apparatus whereby the angle of vertical travel of the baseball can be selectively altered to simulate either an inside pitch or an outside pitch for the batter to swing at.

Yet another feature of the present invention is visual indication of the latching pin engaging the striker indicating the apparatus is ready for use.

BRIEF DESCRIPTION OF THE DRAWINGS

These and other objects, features and advantages of the present invention will be better understood by the following detailed description when taken in conjunction with the accompanying drawings, wherein.

DESCRIPTION OF THE PREFERRED EMBODIMENT

Figure 1:
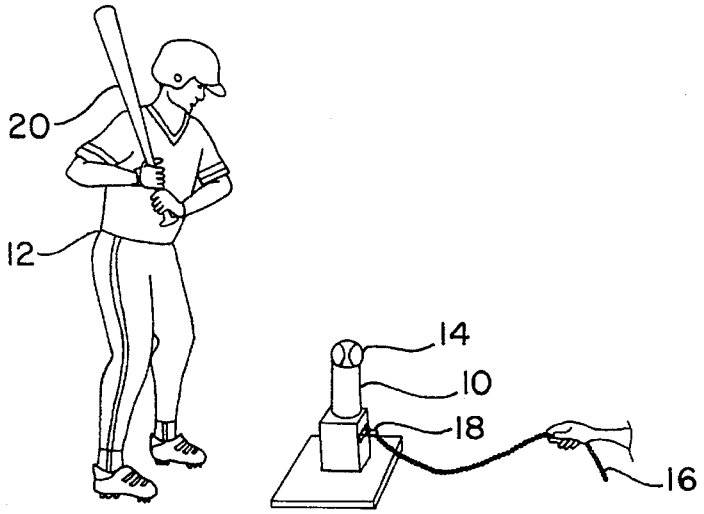
FIG. 1 illustrates the baseball batting training apparatus of this invention with a baseball positioned at the upper end thereof and, a batter standing adjacent the apparatus ready to hit the baseball.

Referring now to FIG. 1 there is seen a baseball training apparatus 10 positioned in front of a batter 12. For purposes of illustration, the training apparatus 10 is shown secured to a rubber support which may have the shape of Home Plate and forms no part of the present invention. A baseball 14 is positioned at the upper end of the training apparatus 10. The baseball may be of any desired weight or size depending on the age and ability of the individual in training. A lanyward 16 is secured to a latching pin 18 and extends from the apparatus to be pulled by a helper.

Figure 2:
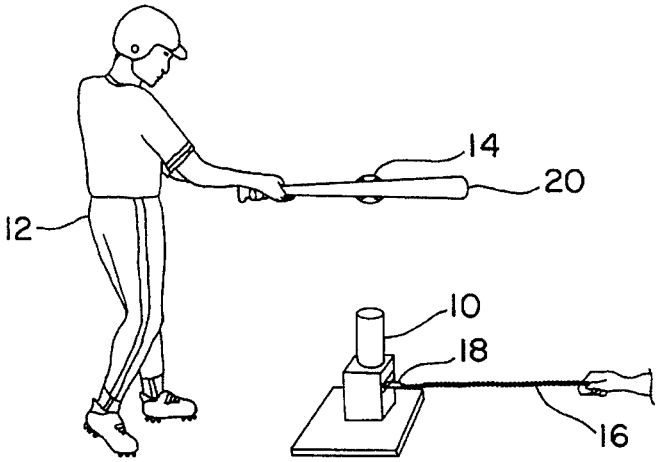
FIG. 2 illustrates the apparatus and batter of FIG. 1 showing the baseball after it has been propelled into the hitting zone of the batter ready to be hit, and further illustrating, in phantom line, baseball positions corresponding to an inside pitch and an outside pitch, which are made possible by the apparatus of the present invention.
Figure 3:
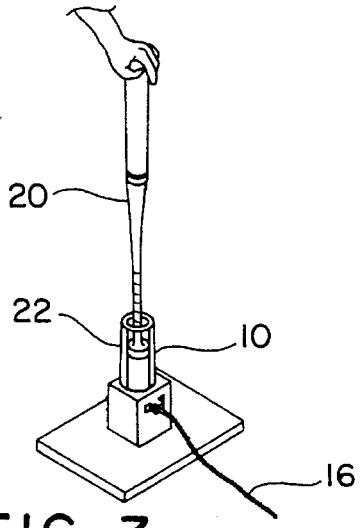
FIG. 3 illustrates a feature of the baseball batting training apparatus of the present invention which allows one end of a baseball bat to be inserted into the apparatus and prepare it for operation.
Figure 5:
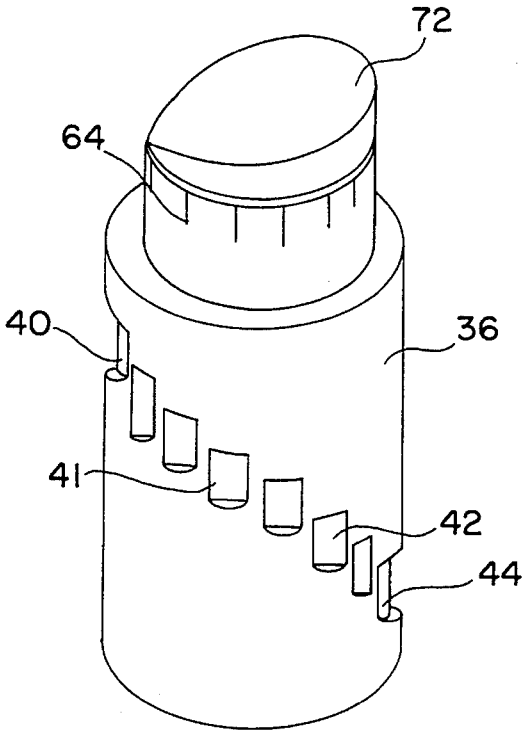
FIG. 5 is a perspective view of the striker used in the apparatus of FIG. 4 showing the plurality of axially spaced apart detentes which are used to select a desired impingement force of the striker to propel the baseball to it's desired height.
Figure 6:
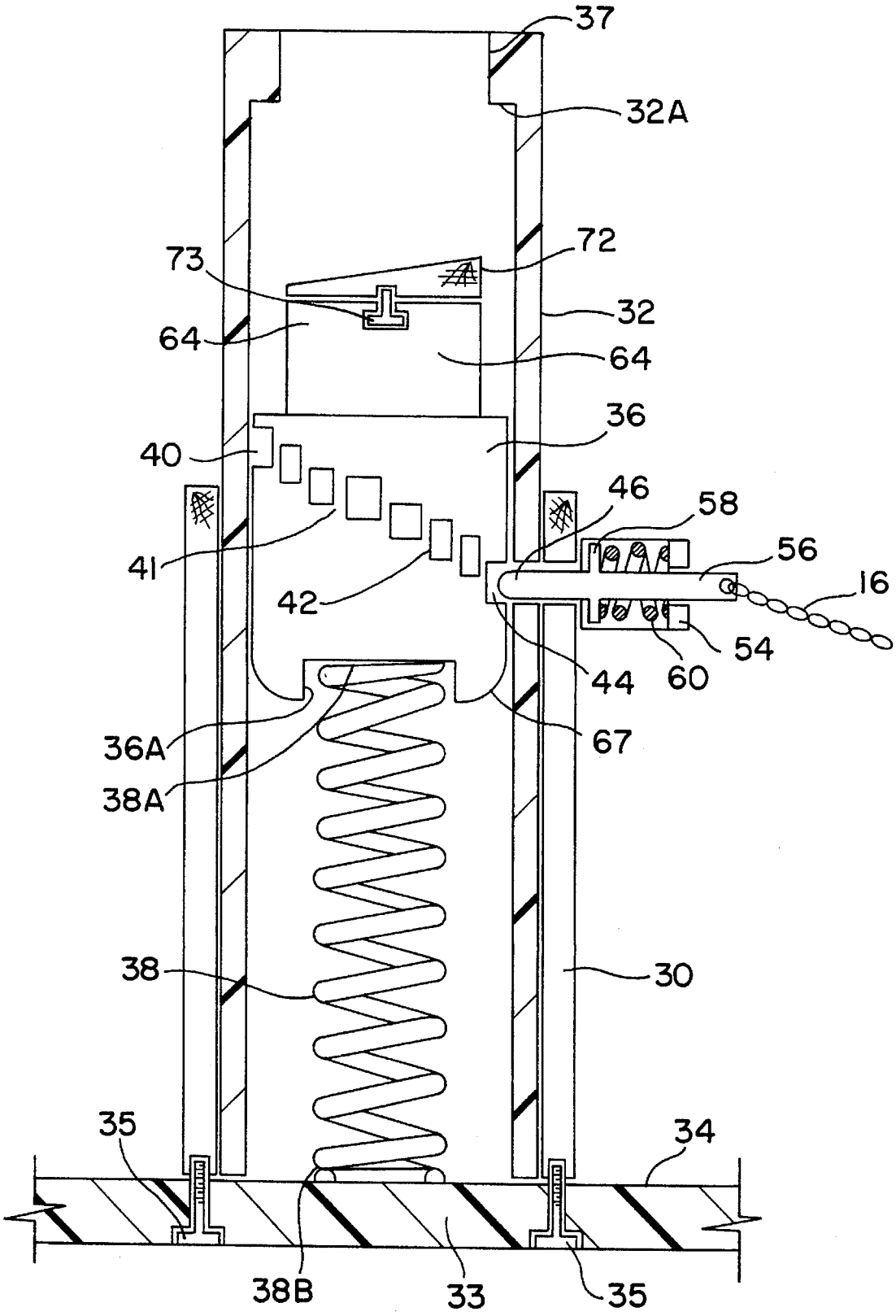
FIG. 6 is a sectional view taken through the apparatus of FIG. 4.

As best seen in FIG. 2 the lanyward 16 is pulled to release the latching pin 18. This action will propel the baseball 14 upward into the hitting zone of the batter 12. After the batter 12 has taken a swing with the baseball bat 20, the batter can quickly and easily reset or cock the training apparatus 10 by placing the small end 22 of the bat 20 on top of the training apparatus 10 and, by pushing down to reset the apparatus. As seen in FIGS. 5 and 6 the rigid-wall tube 32, which forms the main body of the apparatus, has an inside diameter 32*a* larger than the small end 22 of the baseball bat 20. This allows the individual using the apparatus and who has the baseball bat in hand to use the end 22 of the baseball bat 20 to reset the apparatus for another use.

Figure 4:
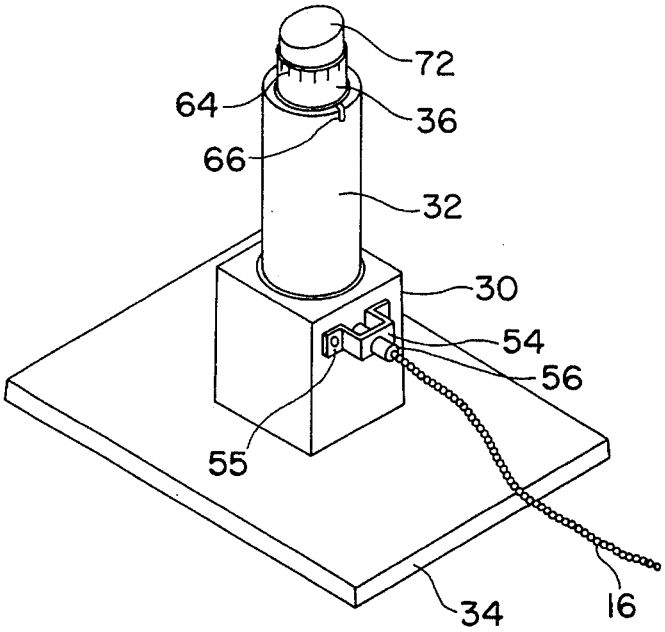
FIG. 4 is a perspective view of the baseball batting training apparatus of this invention.

To more fully appreciate the novel concepts of the present invention refer now to FIGS. 4, 5, and 6 wherein the features of the preferred embodiment are clearly shown. The unique arrangement of elements provides means for adjustment of baseball height as will as adjustment of the upward angle of the baseball within the hitting zone of the batter. The batting training apparatus 20 comprises a main base 30 and a length of rigid-wall cylindrical tube 32 secured therein. The main base 30 is secured to a sub-base 34 by screws 35 to form a closed end 33 for the rigid-wall tube 32. The sub-base 34 is shown fastened to the base 30 by screws 35 but it will be understood that other means may be used to fasten the flange 34 to the base 30. The tube 32 has an open end 37 axially spaced from the closed end 33 and arranged to support the baseball 14. A stop ring is formed at the upper end of the tube 32. The inside diameter of the stop ring 32*a* is smaller than the diameter of the baseball and larger than the diameter of the handle end 22 of the bat 20. This allows the baseball bat to be used for inserting into the tube 32 and set the latching means for use.

A solid cylindrical striker 36 is positioned within the tube 32 and freely moves therein to rest upon one end 38*a* of a coil spring 38 which, in turn, has the other end 38*b* in contact with the closed end 33 of the tube 32. A recess 36*a* is formed at the lower end of the striker to receive the end 38*a* of the spring 38. The striker 36 also has a plurality of axially and angularly spaced detentes 40, 41, 42 and 44 are positioned at selected locations along the striker. While only four detentes are shown herein it will be understood that more or less may be provided without departing from the spirit and scope of this invention. Also, the detentes may be positioned at different radial angles around the perimeter of the striker 36. The selection of one of the detentes 40, 41, 42 and 44 provides adjustment means to change the compression force of the spring 38 and therefore change the force with which the striker 36 engages the baseball 14. The selection of the impinging force of the striker 36 against the baseball 14 will determine the maximum height the baseball will travel upward within the hitting zone of the batter.

The pin 18 has an inwardly directed end 46 to engage a selected one of the detentes 40, 41, 42 and 44. Here the pin 18 is shown engaged with detent 44. When the end 46 of pin 18 engages the detent 40, the spring 38, when compressed, will exert a maximum amount of force and the baseball will be propelled to a minimum height. This may be desirable should a heaver weight baseball be used, such as, for outdoor training or when this apparatus is used for training young adults. When the end 46 of pin 18 is secured to the detent 44, the spring 38, when compressed, will exert a minimum amount of force and the baseball 14 will be propelled to a minimum height. This setting can also be used propel a light weight baseball. It can be seen that by rotating the striker 36 to the desired detent the apparatus 10 can be adjusted to change the impact force of the striker 36.

The pin 18 is secured to and removed from the base 30 by means of a bracket 54 which is secured to the base by screws 55. The lanyard 16 is secured to the exposed end 56 to pull the pin out of engagement with the detent, and thereby allow the striker to impinge the baseball. The pin 18 has a flange 58 to engage one end of a spring 60. The spring 60 has the other end thereof engaging the inner surface of the bracket 54 to urge the end 46 of the pin 18 into the selected detent 40, 41, 42 or 44. To align the desired detent 40, 41, 42 or 44 with the end 46 of the pin 18 the striker 36 is rotated to visually align indexing means 64 with a mark 66 of the upper end the cylinder 32. When the striker 36 is pushed, the end 46 of the pin 18 will ride on the rounded edge 67. This will momentarily push the pin 18 outward before it engages a selected detent. This is a visual indication that the striker is set for use.

At some point during the training exercise the user may want to practice hitting inside pitches or outside pitches. In order to simulate this action the baseball must be presented to the batter at different positions within the hitting zone. In accordance with another feature of this invention, the upper end of the striker 36 is provided with an adjustable deflection plate 72. The deflection plate 72 is used to induce a slight vertical angle to the direction of vertical travel of the baseball which is then presented to the batter at different locations. When the deflection plate is removed from the striker 36 the baseball is propelled substantially vertical. However, with the deflection plate attached by means of a snap pin 73, the baseball will be propelled at slight vertical angles to simulate the different types of pitches, such as either an inside pitch or an outside pitch as. The snap pan 73 allows rotation of the deflection plat for selection of the desired vertical angle of the baseball. It will be understood that the deflection plate 72 may be provided with other adjusting and attaching means such as, for example, by the use of Velcro or the like.

To select the desired height at which the baseball 14 is propelled, the user merely rotates the striker 32 to align the appropriate index 64 with the mark 66. This will register the correct detent 40, 41, 42 or 44 for engagement with the pin 18. Also, the adjustable deflection plate 72, when attached to the upper end of the striker 36 will alter the vertical angle of the baseball to simulate different types of pitches such as an inside pitch or an outside pitch.

Accordingly, the present invention, as disclosed herein, provides a low cost and durable baseball batting training apparatus that is inexpensive to manufacture, easy to assembly and simple to use. It will be understood that specific details and characteristics as set forth in the specification and as shown on the drawings may very without departing from the spirit and scope of the novel concepts of my invention.

What I claim is:

1. An apparatus for presenting a baseball within the hitting zone of a batter, comprising: a base, a rigid-wall tube having an axis extending perpendicular from said base and forming a closed end with said base, said tube having an open end on said axis opposite said closed end and arranged to support a baseball, spring means positioned within said rigid-wall tube and engaged with said closed end, a striker movably mounted within said rigid-wall tube and arranged for selective rotation therein, said striker having axially spaced apart first and second end portions, said first end portion in contact with said spring means and said second end portion in alignment with said open end of said tube for extension therethrough, said striker being movable toward said closed end of said tube, a plurality of pin receiving means on said striker, each pin receiving means spaced axially and annularly within said striker and between said first and second end portions, latching pin means secured to the exterior surface of said rigid-wall tube, said latching pin means having first and second ends and an intermediate flange portion, said first end of said latching pin means extending through said rigid-wall tube for engagement with a selected one of said plurality of pin receiving means of said striker as said striker is moved toward said closed end of said tube, thereby placing said latching pin means in engagement with said selected one of said plurality of pin receiving means to latch said striker, said selected one of said plurality of pin receiving means arranged for alignment with said latching pin means by axially rotation and depression of said striker and, release means attached to said second end of said latching pin means to remove said latching pin means from said selected one of said plurality of pin receiving means, thereby allowing said striker to unlatch and move upward by the force of said spring means to impinge with said baseball and propel said baseball into the hitting zone of a batter to a height determined by said selected one of said plurality of pin receiving means.

2. The apparatus as set forth in claim 1 wherein; said latching pin means includes biasing means between said flange and said second end of said pin to urge said first end of said pin into engagement with said selected one of said plurality of pin receiving means; means on said first portion of said striker to engage said first end of said latching pin means to move said latching pin means outward prior to engagement with said selected one of said plurality of pin receiving means, whereby movement inward of said latching pin means by said bias means visually indicates said apparatus is latched and ready for use, and index means formed on said open end of said tube and said second portion of said striker to visually indicate the selection of a determined one of said plurality of pin receiving means.

3. The apparatus as set forth in claim 1, wherein said rigid-wall tube is cylindrical, and has an inside diameter greater than 1.25 inches and less than 3.5 inches, whereby said apparatus can be cocked by pushing said striker down into said tube with the small end of a baseball bat inserted into said open end of said tube.

4. The apparatus as set forth in claim 1, further including; means secured to said second end portion of said striker and readily selectively positioned relative thereto to cause a baseball to be propelled at a selected upward angle to present the baseball at selectively different locations within a hitting zone of a batter.

5. An apparatus for presenting a baseball within the hitting zone of a batter, comprising; a base, a rigid-wall tube having an axis extending perpendicular from said base and forming a closed end with said base, said tube having an open end on said axis opposite said closed end and arranged to support a baseball, spring means positioned within said rigid-wall tube and engaged with said closed end of said tube, a striker axially and rotatable movably mounted within said rigid-wall tube between latched and unlatched positions, said striker having axially spaced apart first and second end portions, said first end portion in contact with said spring means for compressing said spring means when said striker is moved to a latched position and said second end portion extending through said open end of said tube when said striker is unlatched, a plurality of detent means formed on said striker between said first and second end portions, latching means engaging a selected one of said plurality of detent means on said striker for holding said striker in a latched position with said second end portion of said striker axially between said closed end and said open end of said tube, said selected one of said plurality of detent means arranged for alignment with said latching means by axial rotation and depression of said striker, release means attached to said latching means for release of said striker for movement axially within said tube toward said baseball for impingement therewith, and selector means adjustably secured to said second end portion of said striker to propel a baseball at a selected angle within the hitting zone of a batter, the angle of upward travel of said baseball being determined by said selector means, and the height of travel of said baseball being determined by said selected one of said plurality of detent means, thereby selectively simulating either an inside pitch of selected height or an outside pitch of selected height for the batter to swing at.

6. The apparatus set forth in claim 5 wherein said plurality of detent means are formed uniformly spaced axially and annularly within said striker, said latching means is mounted on said rigid-wall tube and extending therethrough for engagement with said detent means when said striker is moved toward said closed end, thereby selecting the height of travel of said baseball.

7. The apparatus set forth in claim 5 wherein said latching means includes pin means having first and second ends and an intermediate flange portion, said first end of said pin means extending through said rigid-wall tube for latching engagement with said striker as said striker is urged toward said closed end of said tube thereby latching said striker, and means on said first portion of said striker to engage said first end of said latching pin means to move said latching pin means outward prior to engagement with said pin receiving means, whereby movement inward by said bias means visually indicates said apparatus is latched and ready for use.

* * * * *